US009431742B2

(12) United States Patent
DiFonzo et al.

(10) Patent No.: US 9,431,742 B2
(45) Date of Patent: Aug. 30, 2016

(54) SPRING LOADED CONTACTS HAVING SLOPED BACKSIDE WITH RETENTION GUIDE

(71) Applicant: APPLE INC., Cupertino, CA (US)

(72) Inventors: John DiFonzo, Emerald Hills, CA (US); Shuhi Mori, Tokyo (JP)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/740,029

(22) Filed: Jun. 15, 2015

(65) Prior Publication Data

US 2016/0020542 A1 Jan. 21, 2016

Related U.S. Application Data

(63) Continuation of application No. 13/913,494, filed on Jun. 9, 2013, now abandoned.

(60) Provisional application No. 61/657,862, filed on Jun. 10, 2012.

(51) Int. Cl.
*H01R 13/24* (2006.01)

(52) U.S. Cl.
CPC ..... *H01R 13/2421* (2013.01)

(58) Field of Classification Search
CPC ..... H01R 13/2421
USPC ..... 439/700, 284, 824; 324/755.05
See application file for complete search history.

(56) References Cited

U.S. PATENT DOCUMENTS

| | | | |
|---|---|---|---|
| 2,644,145 | A | 6/1953 | Adams |
| 3,378,810 | A | 4/1968 | Dorrell |
| 3,435,168 | A | 3/1969 | Cooney |
| 4,397,519 | A | 8/1983 | Cooney |
| 4,597,622 | A | 7/1986 | Coe |
| 4,612,703 | A | 9/1986 | Cooney |
| 4,686,465 | A | 8/1987 | Krüger |
| 4,874,316 | A | 10/1989 | Kamon et al. |
| 5,417,595 | A | 5/1995 | Cullen et al. |
| 5,801,544 | A | 9/1998 | Swart et al. |
| 5,993,269 | A | 11/1999 | Ito |

(Continued)

FOREIGN PATENT DOCUMENTS

| | | |
|---|---|---|
| CN | 2682638 Y | 3/2005 |
| FR | 2 758 395 A1 | 7/1998 |

(Continued)

OTHER PUBLICATIONS

International Search Report and Written Opinion mailed on Nov. 28, 2012, for PCT Patent Application No. PCT/US2012/059246, 9 pages.

(Continued)

*Primary Examiner* — Neil Abrams

(74) *Attorney, Agent, or Firm* — Kilpatrick Townsend & Stockton LLP

(57) ABSTRACT

A spring-loaded contact may include a barrel to form a housing for the spring-loaded contact, a plunger at least partially enclosed by the barrel, a spring enclosed by the barrel, and a sphere between the plunger and the spring. A back of the plunger may be formed at an angle and to include a retention guide, the retention guide partly over the sphere such that the sphere may be in contact with the back of the plunger and the retention guide.

20 Claims, 7 Drawing Sheets

(56) References Cited

U.S. PATENT DOCUMENTS

| | | | | |
|---|---|---|---|---|
| 6,053,777 | A | 4/2000 | Boyle | |
| 6,159,056 | A | 12/2000 | Boyle | |
| 6,377,059 | B2 * | 4/2002 | Vinther | G01R 1/06722 324/72.5 |
| 6,447,328 | B1 * | 9/2002 | Feldman | G01R 1/07314 324/755.05 |
| 6,506,082 | B1 | 1/2003 | Meek et al. | |
| 6,604,864 | B2 | 8/2003 | Nguyen | |
| 6,696,850 | B1 * | 2/2004 | Sanders | G01R 1/06711 324/755.05 |
| 6,861,862 | B1 | 3/2005 | Tate | |
| 6,957,986 | B2 | 10/2005 | Jing | |
| 7,315,176 | B2 * | 1/2008 | Nelson | G01R 1/06722 324/755.05 |
| 7,611,389 | B2 | 11/2009 | Toivanen et al. | |
| 7,682,206 | B2 | 3/2010 | Kainz | |
| 7,798,867 | B2 | 9/2010 | Sanders | |
| 8,043,103 | B2 | 10/2011 | Yamada et al. | |
| 8,734,189 | B2 | 5/2014 | Kim | |
| 8,905,795 | B2 * | 12/2014 | Kim | H01R 13/62 439/482 |
| 8,926,376 | B2 * | 1/2015 | Mori | H01R 13/2421 439/482 |
| 9,130,317 | B2 * | 9/2015 | Wang | H01R 13/6683 |
| 2003/0124895 | A1 | 7/2003 | Winter et al. | |
| 2003/0176113 | A1 | 9/2003 | Sasaki | |
| 2004/0137800 | A1 | 7/2004 | Jing | |
| 2011/0018567 | A1 | 1/2011 | Shiga | |
| 2013/0095707 | A1 | 4/2013 | Kim et al. | |
| 2013/0330983 | A1 | 12/2013 | DiFonzo et al. | |
| 2015/0140870 | A1 | 5/2015 | Kim et al. | |

FOREIGN PATENT DOCUMENTS

| | | | |
|---|---|---|---|
| JP | S50-8785 | Y1 | 3/1975 |
| JP | S62-76668 | U | 5/1987 |
| JP | S63-23655 | U | 2/1988 |
| JP | S63-274070 | A | 11/1988 |
| JP | H09-072932 | A | 3/1997 |
| JP | H10-40990 | A | 2/1998 |
| JP | 10-282142 | A | 10/1998 |
| JP | 10-332767 | A | 12/1998 |
| JP | 2001-021583 | A | 1/2001 |
| JP | 2002-174642 | A | 6/2002 |
| JP | 2003281984 | | 10/2003 |
| JP | 2004-179066 | A | 6/2004 |
| JP | 2005-005146 | A | 1/2005 |
| JP | 2005005146 | A | 1/2005 |
| JP | 2006-501475 | A | 1/2006 |
| JP | 2007-316023 | A | 12/2007 |
| JP | 2011-027549 | A | 2/2011 |
| JP | 2011-192407 | A | 9/2011 |
| JP | 2013-68593 | A | 4/2013 |
| KR | 20-0255378 | B1 | 12/2001 |
| TW | 200301592 | A | 7/2003 |
| TW | 563929 | U | 11/2003 |
| TW | M312806 | U | 5/2007 |
| TW | I286409 | B | 9/2007 |
| TW | 200803072 | | 1/2008 |
| TW | I289376 | A | 11/2008 |
| TW | M406183 | U | 6/2011 |
| WO | 98/04018 | A2 | 1/1998 |
| WO | 98/04018 | A3 | 1/1998 |
| WO | 2005/053106 | A1 | 6/2005 |
| WO | 2013/035399 | A1 | 3/2013 |

OTHER PUBLICATIONS

International Search Report and Written Opinion mailed on Aug. 7, 2013, for PCT Patent Application No. PCT/US2013/044991, 12 pages.

Non-Final Office Action mailed on Jul. 19, 2013 for U.S. Appl. No. 13/272,200, 7 pages.

Notice of Allowance mailed on Jan. 15, 2014 for U.S. Appl. No. 13/272,200, 11 pages.

Non-Final Office Action mailed on Feb. 24, 2014 for U.S. Appl. No. 13/492,905, 6 pages.

Taiwanese Office Action mailed on Jun. 10, 2014, for TW Patent Application No. 101137808, with English Translation, 14 pages.

Chinese Office Action mailed on Jul. 24, 2014 for CN Patent Application No. 201210385775.6, 15 pages.

Australian Office Action mailed on Aug. 5, 2014 for AU Patent Application No. 2012323384, 4 pages.

Notice of Allowance mailed on Sep. 17, 2014 for U.S. Appl. No. 13/492,905, 10 pages.

Notice of Allowance mailed on Aug. 1, 2014 for U.S. Appl. No. 13/913,494, 8 pages.

Notice of Allowance mailed on Nov. 20, 2014 for U.S. Appl. No. 13/913,494, 9 pages.

Notice of Allowance mailed on Mar. 13, 2015 for U.S. Appl. No. 13/913,494, 8 pages.

European Office Action mailed Oct. 14, 2015 for EP Application No. 12779238.0, 5 pages.

Chinese Office Action mailed Nov. 5, 2015 for CN Patent Application No. 201210385775.6, 7 pages.

Japanese Office Action mailed Jan. 7, 2016 for JP Patent Application No. 2014-535770, 7 pages.

Korean Notice of Allowance mailed on Jan. 21, 2016 for KR Patent Application No. 10-2014-7012587, with English translation, 3 pages.

Taiwanese Office Action mailed on Feb. 25, 2016, for TW Patent Application No. 10113190, 10 pages.

Taiwanese Search Report mailed on Feb. 25, 2016, for TW Patent Application No. 10113190, 1 page.

Restriction Requirement mailed on Mar. 7, 2016 for U.S. Appl. No. 14/503,307, 5 pages.

U.S. Appl. No. 14/503,307, Non-Final Office Action, dated Jul. 14, 2016, 7 pages.

China Patent Application No. 201210385775.6, Office Action, dated May 6, 2016, 18 pages.

Japan Patent Application No. 2014-535770, Notice of Allowance, dated Jun. 10, 2016, 3 pages.

* cited by examiner

SPRING LOADED CONTACTS HAVING SLOPED BACKSIDE WITH RETENTION GUIDE

CROSS-REFERENCES TO RELATED APPLICATIONS

This application is a continuation of U.S. patent application Ser. No. 13/913,494, filed Jun. 9, 2013, now abandoned, which is a non-provisional of U.S. provisional patent application No. 61/657,862, filed Jun. 10, 2012, which are incorporated by reference.

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive power and share data using various cables. These cables may have connector inserts, or plugs, on each end. The connector inserts may plug into connector receptacles on electronic devices, thereby forming one or more conductive paths for signals and power.

These inserts or plugs may have contacts that mate with corresponding contacts in a receptacle. These mated contacts may form portions of electrical paths for data, power, or other types of signals. Various types of contacts may be used. One type of contact, a spring-loaded contact, may be used in either a connector insert or a connector receptacle.

Spring-loaded contacts may include a plunger biased by a spring, such that the plunger may be depressed when contacting a second contact, then retracted when disengaged from the second connector. But this arrangement may lead to a reduced reliability for the spring-loaded contact. For example, the spring and plunger may become entangled. That is, the spring may become caught between a plunger and a barrel or housing of the spring-loaded contact. This may prevent the plunger from retracting, thus keeping the plunger depressed.

Also, when a plunger makes contact with a second contact and is depressed, the plunger may break contact with the barrel or housing. This may lead to large current flow through the spring, which may in turn damage or destroy the spring.

Thus, what is needed are spring-loaded contacts that provide an improved reliability by having a reduced tendency for entanglement between a spring and a plunger, and a reduced chance of large currents flowing through the spring.

SUMMARY

Accordingly, embodiments of the present invention may provide spring-loaded contacts having an improved reliability. An illustrative embodiment of the present invention may provide a spring-loaded contact. The spring-loaded contact may include a barrel to form a housing for the spring-loaded contact, a plunger at least partially enclosed by the barrel, a spring enclosed by the barrel, and a sphere between the plunger and the spring. A back of the plunger may be formed at an angle and include a retention guide, the retention guide partly over the sphere such that the sphere may be in contact with the back of the plunger and the retention guide.

Another illustrative embodiment of the present invention may provide a spring-loaded contact. This spring-loaded contact may include a barrel to form a housing for the spring-loaded contact and a plunger at least partially enclosed by the barrel. The plunger may include a front end to form an electrical connection at a surface of a contact of a connector receptacle and a back end having a surface formed at an angle and including a boss emerging from the surface, the boss forming a retention guide. The spring-loaded contact may further include a spring enclosed by the barrel, and a spherical isolating object located between the plunger and the spring. The spherical isolating object may be in contact with the surface of the back end and the retention guide.

Another illustrative embodiment of the present invention may provide another spring-loaded contact. This spring-loaded contact may include a barrel to form a housing for the spring-loaded contact, a plunger at least partially enclosed by the barrel, a spring enclosed by the barrel, a first sphere, and a second sphere. The back of the plunger may be cup-shaped, wherein the cup-shape has a slot such that the cup-shape receives the first sphere and the slot receives the second sphere.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
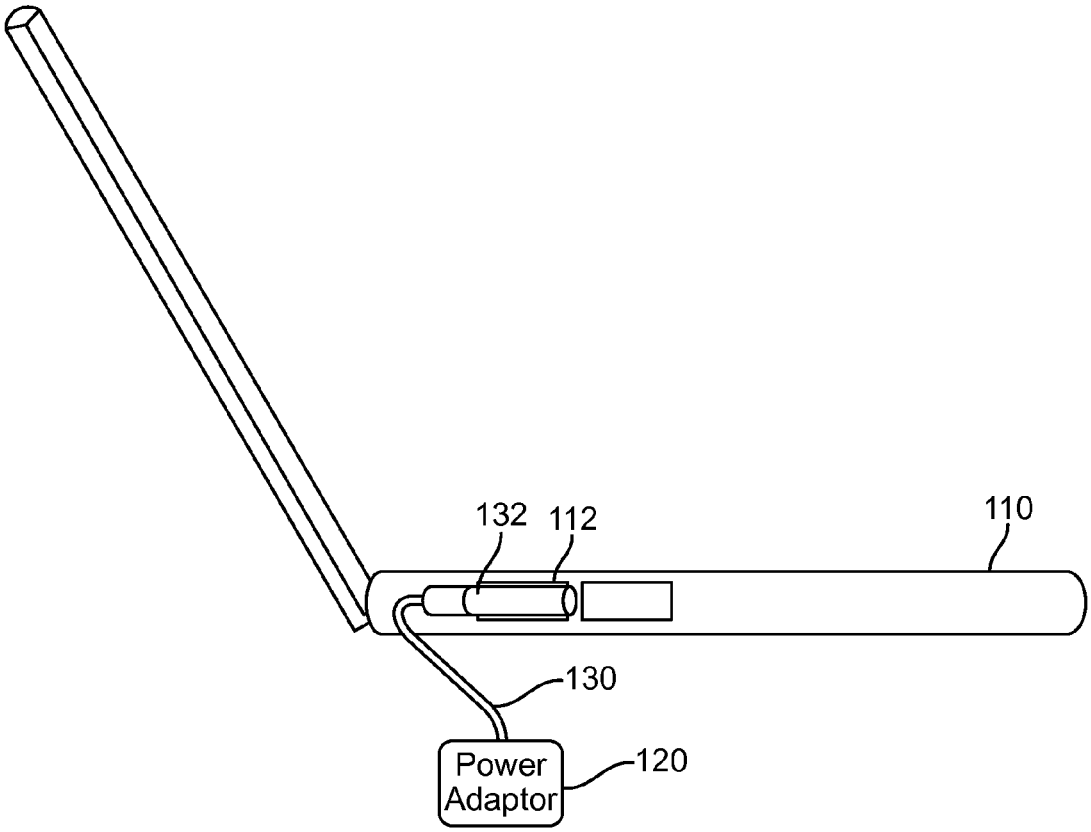
FIG. 1 (PRIOR ART)
FIG. 1 illustrates a magnetic connector system that may be improved by the incorporation of an embodiment of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

This figure includes electronic device 110. In this specific example, electronic device 110 may be a laptop computer. In other embodiments of the present invention, electronic device 110 may be a netbook or tablet computer, cell, media, or smart phone, global positioning device, media player, or other such device.

Electronic device 110 may include a battery. The battery may provide power to electronic circuits in electronic device 110. This battery may be charged using power adapter 120. Specifically, power adapter 120 may receive power from an external source, such as a wall outlet or car charger. Power adapter 120 may convert received external power, which may be AC or DC power, to DC power, and it may provide the converted DC power over cable 130 to plug 132. In other embodiments of the present invention, plug, or insert 132 may be coupled through cable 130 to another type of device. Plug 132 may be arranged to mate with receptacle 112 on electronic device 110. Power may be received at receptacle 112 from plug 132 and provided to the battery and electronic circuitry in electronic device 110. In other embodiments of the present invention, data or other types of signals may also be provided to electronic device 110 via plug or insert 132.

Figure 2:
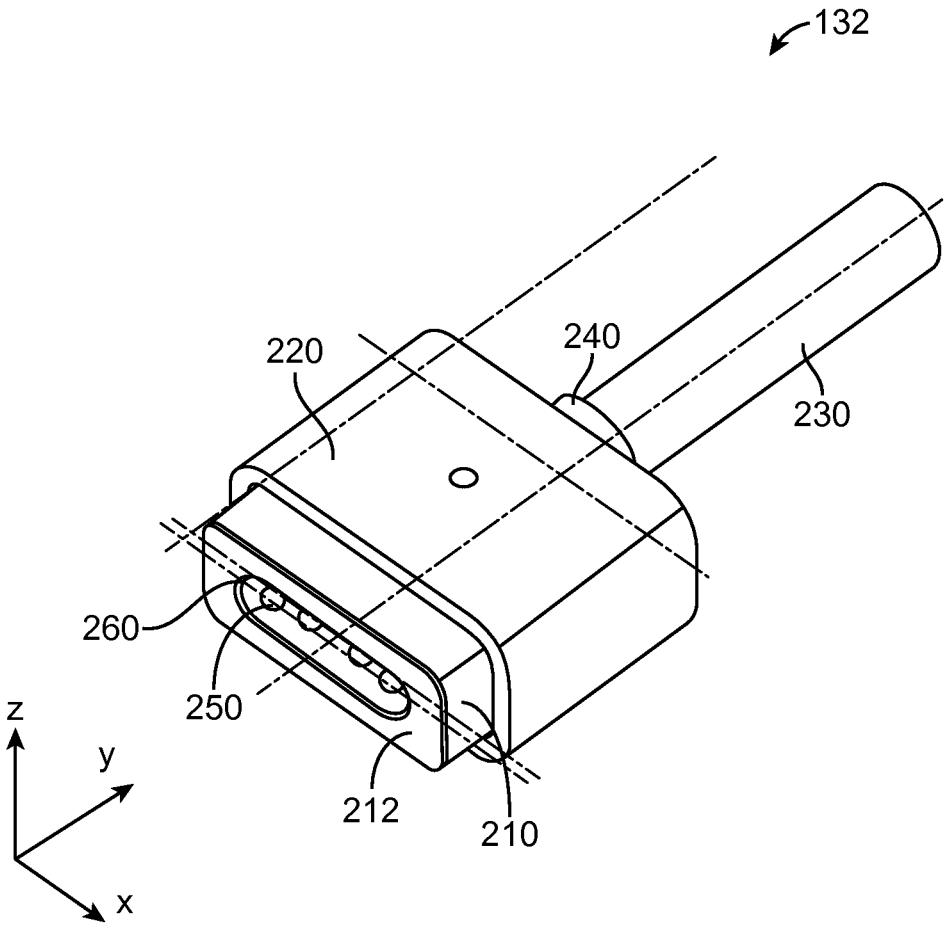
FIG. 2 (PRIOR ART)
FIG. 2 illustrates a connector insert that may be improved by the incorporation of an embodiment of the present invention.

FIG. 2 illustrates a connector insert 132 that may be improved by the incorporation of an embodiment of the present invention. Connector insert 132 may include an attraction plate 210, shield or cover 220, cable 230, and strain relief 240. Attraction plate 210 may include front surface 212. Front surface 212 may include opening 260 for contacts 250.

In various embodiments of the present invention, contacts 250 may be spring-loaded contacts. Examples of spring-loaded contacts according to embodiments of the present invention are shown in the following figures.

Figure 3:
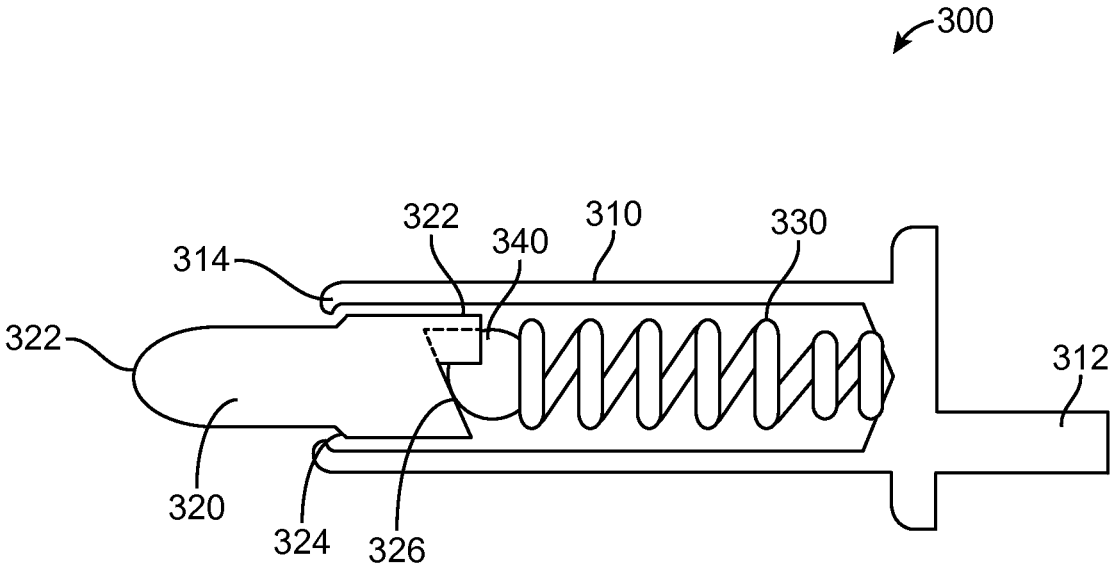
FIG. 3 illustrates a spring-loaded contact according to an embodiment of the present invention.

FIG. 3 illustrates a spring-loaded contact according to an embodiment of the present invention. Spring-loaded contact 300 may be used as contacts 250 in FIG. 2. Spring-loaded contact 300 may be housed in a housing or barrel 310. Barrel 310 may include tail 312. Tail 312 may be soldered to a printed circuit board or other structure in a connector, such as connector insert 132 in FIG. 2.

Spring-loaded contact 300 may further include plunger 320. Plunger 320 may have tip 322 to mate with a second contact in a connector receptacle. Plunger 320 may further include notch or wider portion 324. Notch 324 may contact portion 314 of housing 310, thereby limiting the retraction of plunger 320.

Spring-loaded contact 300 may further include a compliance mechanism, such as spring 330. Spring 330 may extend to retract plunger 320 from barrel 310 when a connector that houses spring-loaded contact 300 is disengaged from a corresponding connector. Spring 330 may compress, thereby allowing plunger 320 to be depressed into housing or barrel 310 when the connector that houses spring-loaded contact 300 is engaged with the corresponding connector.

Again, in conventional spring-loaded contacts, a spring may become entangled with a plunger during use. For example, a spring may become caught between a plunger and a barrel or housing. This may prevent the plunger from retracting fully from the housing. This, in turn, may lead to either or both cosmetic and functional failures.

Also, as a plunger is depressed, it may lose contact with a barrel or housing of the spring-loaded contact. Under these circumstances, current may flow through the spring. While this condition may be reasonable when the spring-loaded contact is conveying a signal, it may be damaging when a power supply or ground return is conveyed. This current flow may damage or destroy the spring. Specifically, resistance in the spring may lead to its being heated by the current flow. This heating may cause the spring to lose its elasticity. Such damage may again cause cosmetic or functional failures.

Accordingly, embodiments of the present invention may employ a sphere or spherical isolation object 340 between plunger 320 and spring 330, and angled back to plunger 320, where the back of plunger 320 further includes retention guide 322. With these features, when plunger 320 is depressed, plunger 320 maintains contact with barrel 310 and sphere 340 isolates spring 330 such that spring 330 is protected from large currents.

In this specific example, sphere 340 contacts plunger 320 at a back surface 326 and at retention guide 322. Back surface 326 may be angled such that when plunger 320 is depressed, plunger 320 is tilted relative to a center line through spring-loaded contact 300 and maintains contact with barrel 310. Specifically, the slope or angle at the back surface 326 of plunger 320 forces plunger 320 into a side of barrel 310. Contact resulting from this force may help to reduce the low-level contact resistance of spring-loaded contact 300. An example is shown in the following figure.

Figure 4:
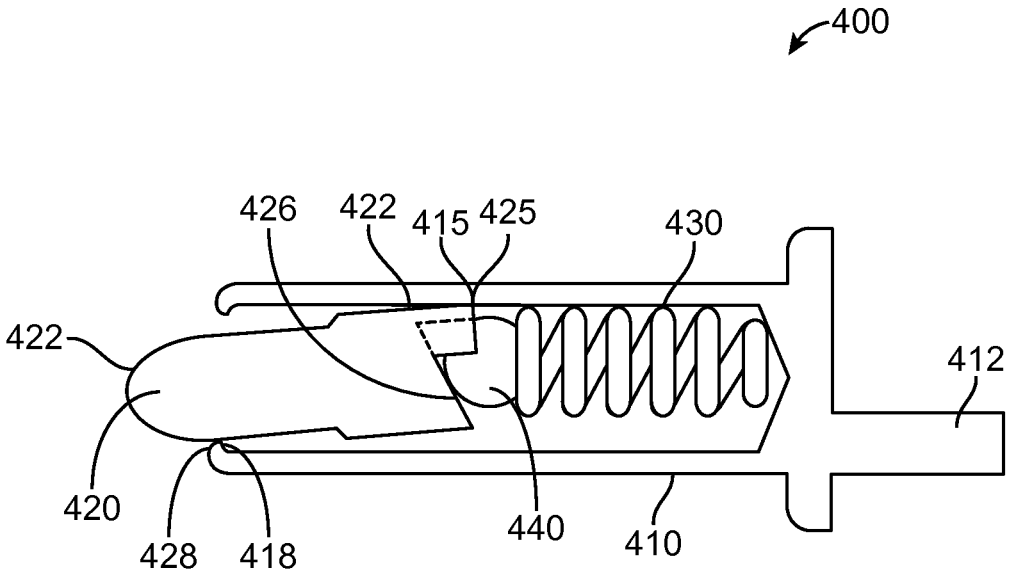
FIG. 4 illustrates the spring-loaded contact of FIG. 3 where a plunger has been depressed.

FIG. 4 illustrates the spring-loaded contact of FIG. 4 where a plunger has been depressed. Specifically, plunger 420 is shown as being depressed relative to housing 410. In this figure, spring 430 is compressed and sphere 440 is pushed further back into housing 410. The angled back surface 426 of plunger 420 acts to tilt plunger 420 into housing 410. Specifically, point 428 of plunger 420 may contact housing or barrel 410 at point 418. Similarly, point 425 of plunger 420 may contact housing or barrel 410 at point 415.

This configuration provides at least two electrical paths from tip 422 of plunger 420 to tail 412 of housing 410. Specifically, current may flow from tip 422 to point 428 of plunger 420 to point 418 of housing 410, then to tail 412. Current may also flow from tip 422 to point 425 on plunger 420, then to point 415 on barrel 410, then to tail 412. Depending on the exact geometries and relative position of these components, some or all of these or other electrical paths may be formed as plunger 420 is depressed relative to barrel 410.

Figure 5:
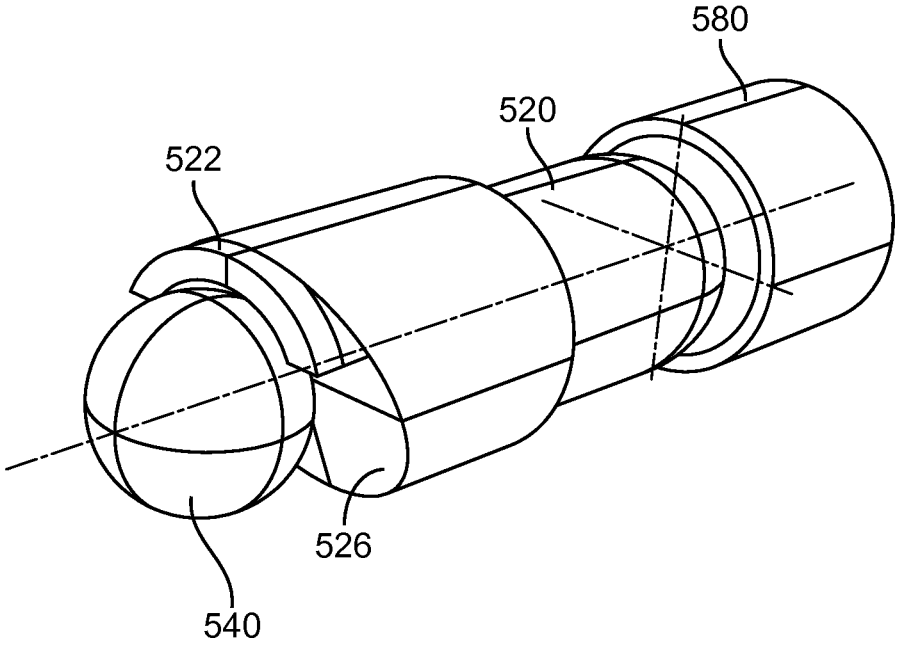
FIG. 5 illustrates a spring isolation object and a plunger according to an embodiment of the present invention.

FIG. 5 illustrates a portion of a spring-loaded contact according to an embodiment of the present invention. This portion of a spring-loaded contact may include sphere or spherical isolation object 540 and plunger 520. Plunger 520 may form an electrical connection with a second contact 580, which may be located in a connector receptacle. Plunger 520 may include an angled backside 526 and a retention guide 522. Sphere 540 may contact angled backside 526 and retention guide 522.

In various embodiments of the present invention, plunger 520 may be formed in various ways. For example, plunger 520 may be formed using a metal lathe or metalworking lathe. For example, plunger 520 may be formed using a computer numerical controlled (CNC) lathe. In other embodiments of the present invention, plunger 520 may be formed using metal injection molding, three-dimensional printing, micromachining, etching, or other technique. In various embodiments of the present invention, retention guide 522 may be formed with the rest of plunger 520 as a single unit, though in other embodiments of the present invention they may be formed separately.

In various embodiments of the present invention, the composition of the components of these spring-loaded contacts may vary. For example, the plunger and barrel may be brass or other copper based material, such as bronze. The plunger and barrel may further be plated, for example with gold. The spring may be formed of conductive or nonconductive material, including stainless steel, such as stainless steel 304, or other appropriate material. For example, music wire or high-tensile steel may be used. The spring may be plated with gold, silver, or other material. The sphere or spherical isolation object may be made of various nonconductive materials, such as ceramics, plastics, or other materials.

Figure 6:
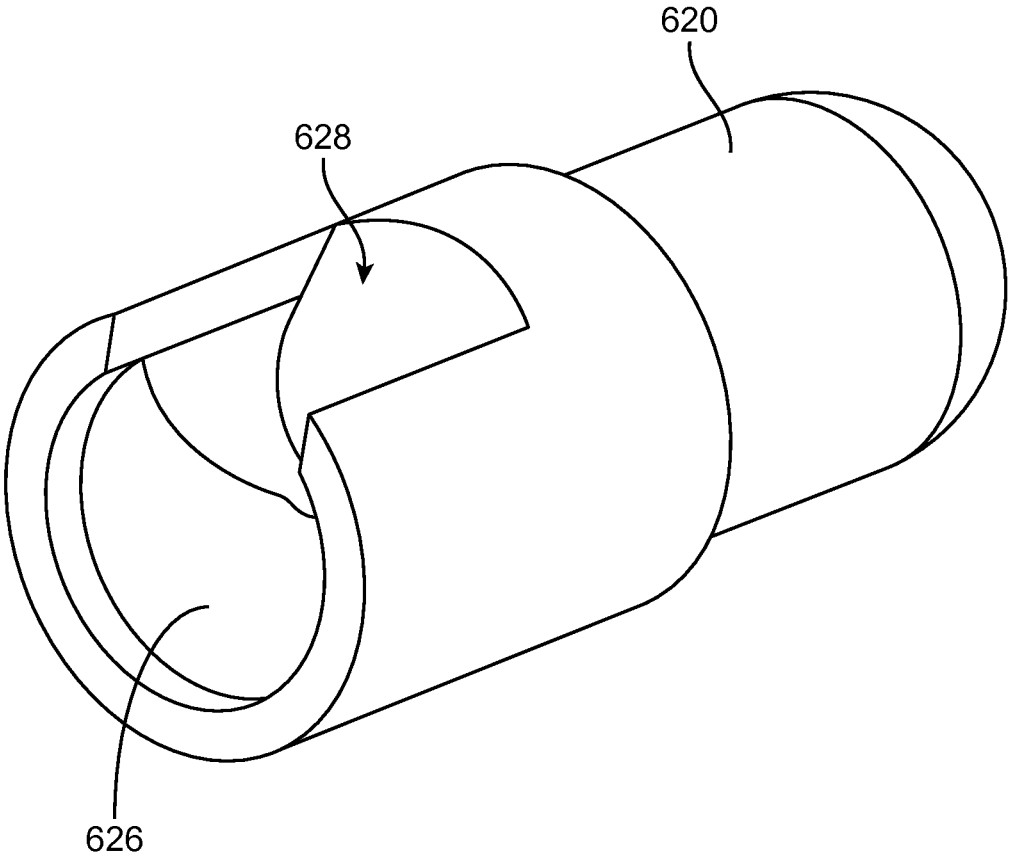
FIG. 6 illustrates a plunger according to an embodiment of the present invention.

FIG. 6 illustrates a plunger according to an embodiment of the present invention. In this example, plunger 620 may have a back that may have a cup-shaped surface 626 with slot 628. Cup-shaped surface 626 may receive an isolation object, while slot 628 may receive an additional object. In a specific embodiment of the present invention, cup-shaped surface 626 may receive a spherical isolation object, while slot 628 may receive a spherical additional object. An example is shown in the following figure.

Figure 7:
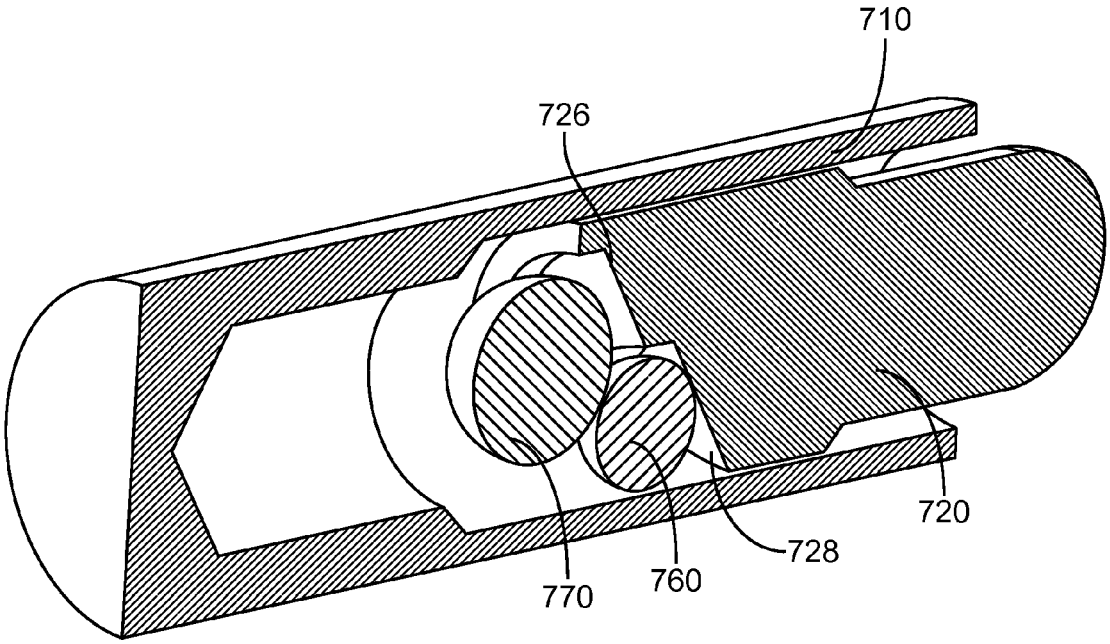
FIG. 7 illustrates a cutaway view of a portion of a spring-loaded contact according to an embodiment of the present invention.

FIG. 7 illustrates a cutaway view of a portion of a spring-loaded contact according to an embodiment of the present invention. In this example, the actual spring has been omitted for clarity.

Again, plunger 720 may have a cup-shaped surface 726 for receiving an isolation object 770. In this specific example, isolation object 770 may be spherical, though in other embodiments of the present invention, isolation object 770 may have other shapes. Isolation object 770 may be located between plunger 720 and a spring (not shown). Isolation object 770 may be nonconductive, though in other embodiments of the present invention, isolation object 770 may be conductive.

Cup shaped surface 726 may include slot 728 for receiving an additional object 760. In this specific example, additional object 760 may be a second symmetrical object. Additional object 760 may be conductive, though in other embodiments of the present invention, additional object 760 may be nonconductive.

In this arrangement, both isolation object 770 and additional object 760 contact a back surface of plunger 720. This provides a reliable and redundant contacting mechanism. Also in this arrangement, both additional object 760 and plunger 720 are pushed towards the outer edge and into contact with barrel 710, thereby improving contact. This improved contact, along with the use of a nonconductive isolation object 770, may help to protect the spring (not shown) from large currents during operation. Moreover, since at least part of one or both of the isolating object 770 or additional object 760 are located within a back portion of plunger 720, an overall length of the spring-loaded contact may be reduced.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A spring-loaded contact comprising:
- a barrel to form a housing for the spring-loaded contact;
- a plunger at least partially enclosed by the barrel;
- a spring enclosed by the barrel;
- a first sphere; and
- a second sphere,
- wherein a back of the plunger is cup-shaped, wherein the cup-shape has a slot such that the cup-shape receives the first sphere and the slot receives the second sphere.

2. The spring-loaded contact of claim 1 wherein the first sphere is nonconductive.

3. The spring-loaded contact of claim 1 wherein the second sphere is conductive.

4. The spring-loaded contact of claim 1 wherein the spring is formed using stainless steel.

5. The spring-loaded contact of claim 4 wherein the spring is gold-plated.

6. The spring-loaded contact of claim 4 wherein the spring is coated in a dielectric.

7. The spring-loaded contact of claim 6 wherein the dielectric is parylene.

8. The spring-loaded contact of claim 1 wherein the plunger is formed of a copper-based material.

9. The spring-loaded contact of claim 1 wherein the first sphere and the second sphere are between the back of the plunger and the spring.

10. A spring-loaded contact comprising:
- a barrel to form a housing for the spring-loaded contact, the barrel having a front opening;
- a spring enclosed by the barrel;
- a plunger at least partially enclosed by the barrel, the plunger having a body between the spring and the front opening and a contacting portion extending beyond the front opening, a back of the plunger having a cup-shaped depression; and
- an isolation object in the cup-shaped depression in the back of the plunger,
- wherein the back of the plunger further comprises a slot, the spring loaded contact further comprising:
- an additional object located in the slot in the back of the plunger.

11. The spring-loaded contact of claim 10 wherein the isolation object is a sphere.

12. The spring-loaded contact of claim 11 wherein the isolation object is formed of a ceramic.

13. The spring-loaded contact of claim 11 wherein the isolation object is formed of a plastic.

14. The spring-loaded contact of claim 10 wherein the additional object is a sphere.

15. The spring-loaded contact of claim 14 wherein the additional object is a conductive.

16. The spring-loaded contact of claim 10 wherein the spring is formed using stainless steel.

17. The spring-loaded contact of claim 16 wherein the spring is coated in a dielectric, wherein the dielectric is parylene.

18. A spring-loaded contact comprising:
- a barrel to form a housing for the spring-loaded contact, the barrel having a front opening and an opposing rear wall;
- a plunger at least partially enclosed by the barrel and emerging from the front opening, a back of the plunger having a cup shaped depression and a slot in the cup-shaped depression;
- an isolation object in the cup-shaped depression in the back of the plunger,
- an additional object in the slot in the cup-shaped depression; and
- a spring enclosed by the barrel, the spring between the rear wall and the isolation object.

19. The spring-loaded contact of claim 18 wherein the isolation object is a non-conductive sphere and the additional object is a conductive sphere.

20. The spring-loaded contact of claim 19 wherein the spring is stainless steel and coated in a dielectric, wherein the dielectric is parylene.

* * * * *